United States Patent [19]

Eldridge

[11] Patent Number: 4,896,139

[45] Date of Patent: Jan. 23, 1990

[54] SELF-CONTAINED BURGLAR ALARM DEVICE FOR SLIDING WINDOWS, DOORS AND THE LIKE

[76] Inventor: Alan E. Eldridge, 4830 S. Bahama Way, Aurora, Colo. 80015

[21] Appl. No.: 193,111

[22] Filed: May 11, 1988

[51] Int. Cl.[4] ..... G08B 13/08

[52] U.S. Cl. ..... 340/546; 200/61.71; 200/61.93

[58] Field of Search ..... 340/546, 545; 200/61.93, 61.74, 61.73, 61.71

[56] References Cited

U.S. PATENT DOCUMENTS

| | | | |
|---|---|---|---|
| 3,797,005 | 3/1974 | Schwarz | 340/545 |
| 4,193,067 | 3/1980 | Hawkins | 340/546 |
| 4,472,709 | 9/1984 | White | 340/546 |
| 4,495,486 | 1/1985 | White | 200/61.93 |
| 4,553,134 | 11/1985 | Holt | 200/61.93 |

*Primary Examiner*—Glen R. Swann, III

*Attorney, Agent, or Firm*—John L. Isaac

[57] ABSTRACT

An elongated housing has first and second ends and an alarm responsive to an electrical signal. A switch is provided for controlling the electrical signal and includes contact elements for activating the alarm in each of two activation modes corresponding to compression and extension of the housing. A mechanism is disposed at the housing first end for adjusting the length of the housing. Finally, a mechanism is disposed proximate the housing second end for enabling movement of the contact elements to initiate the two activation modes from an inactive alarm mode in cooperation with the housing length adjustment mechanism.

35 Claims, 3 Drawing Sheets

SELF-CONTAINED BURGLAR ALARM DEVICE FOR SLIDING WINDOWS, DOORS AND THE LIKE

BACKGROUND OF THE INVENTION

Field of the Invention

This invention relates generally to security systems for residential and commercial structures and, more particularly, to burglar alarm devices for closures such as windows, sliding doors, and the like. Specifically, the present invention relates to an improved burglar alarm having more than one activation mode for use with movable closures.

Description of the Prior Art

Security systems for homes and offices are quite varied and diverse and range from extremely sophisticated and expensive electronic systems to simple locking mechanisms and the like. The degree of security provided by any particular device or system is somewhat related to the sophistication and expense of the system. For many residential uses, a complete security system for doors, windows and other entry points is frequently cost-prohibitive for the average consumer. However, the number of residential burglaries has continuously increased over the years leading to a greater consumer need and demand for such systems. Thus, there is a need for simplified burglar alarms or security systems which are easy to use and inexpensive to manufacture and purchase.

Bar or stick alarms for closures having movable members, such as sliding doors and windows, are well known in the art. Examples of such devices are illustrated in U.S. Pat. Nos. 3,797,005, 4,193,067, 4,472,709, 4,495,486 and 4,553,134. Devices such as those illustrated in these prior art references, include bars or rods which are placed between a stationary window jamb or door frame and an edge of the slidable, moving member. When the movable member of the closure is then opened, a plunger or similar type of mechanism projecting from the rod is struck by the movable member and closes an electrical circuit, thereby activating an alarm.

While such devices are relatively effective and simple to install, there are several disadvantages with the systems disclosed in these references. One such disadvantages is that a burglar or intruder can break the closure glass and simply detach the burglar alarm stick without activating it. Once the stick has been detached from the movable member, the intruder can pry the movable closure member open and gain entry to the residence or office. Hence, there is no alarm mode for unauthorized or inadvertent removal of the alarm stick from its position against the closure. In addition, the devices as disclosed in these references include rather sophisticated plunger circuitry as well as some complex alarm mechanisms. Thus, there remains a distinct need in the home security field for a simplified burglar alarm for residences and offices which can operate in more than one activation mode, is simple in design and use, and is inexpensive.

SUMMARY OF THE INVENTION

Accordingly, it is one object of the present invention to provide an alarm device for use with closures such as windows, sliding doors and the like, which device is simple in construction and inexpensive to manufacture.

It is another object of the present invention to provide an alarm device for use with closures such as as windows, sliding doors and the like, wherein the device may be activated by either unauthorized opening of the closure or by unauthorized removal of the device from its position relative to the closure.

A further object of the present invention is to provide a burglar stick alarm for use with closures having movable members such as sliding doors, windows and the like, wherein the alarm mechanism and switching mechanism are entirely incorporated within the structure of the stick or rod itself without cumbersome alarm attachments and the like.

Yet another object of the present invention is to provide a burglar alarm stick which is adjustable in length for closures of various sizes and is not permanently attached to the closure.

To achieve the foregoing and other objects and in accordance with the purpose of the present invention, as embodied and broadly described herein, an alarm device for closures such as windows, sliding doors, and the like is disclosed. The device includes an elongated housing having first and second ends and an alarm responsive to an electrical signal. A switch is provided for controlling the electrical signal and includes a contact arrangement for activating the alarm in each of two activation modes. A mechanism is disposed at the housing first end for adjusting the length of the housing. Finally, a mechanism is disposed proximate the housing second end for enabling movement of the contact arrangement to initiate the two activation modes from an inactive alarm mode in cooperation with the housing length adjustment mechanism.

BRIEF DESCRIPTION OF THE DRAWINGS

The accompanying drawings which are incorporated in and form a part of this specification, illustrate preferred embodiments of the present invention, and together with the description, serve to explain the principles of the invention. In the drawings.

DETAILED DESCRIPTION OF THE PREFERRED EMBODIMENTS

Figure 1:
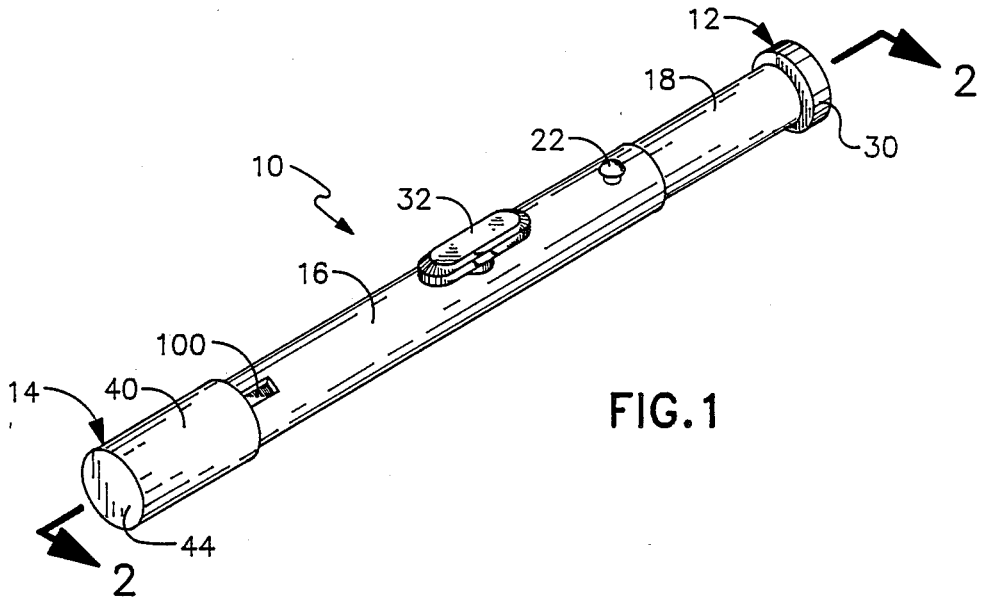
FIG. 1 is perspective view of one embodiment constructed in accordance with the present invention.
Figure 3:
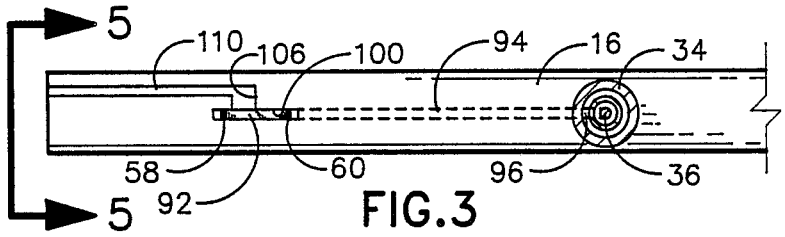
FIG. 3 is a partial top plan view, with some parts in section and some in shadow, of a portion of the device illustrated in FIG. 1 as taken substantially along line 3—3 of FIG. 2.
Figure 4:
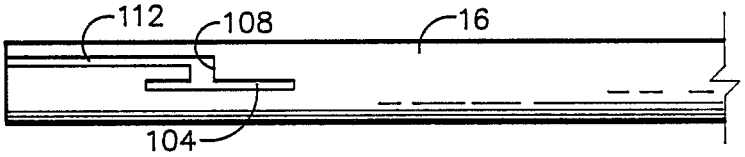
FIG. 4 is a partial, bottom plan view of a portion of the device illustrated in FIG. 2 as taken substantially along line 4—4 of FIG. 2.
Figure 2:
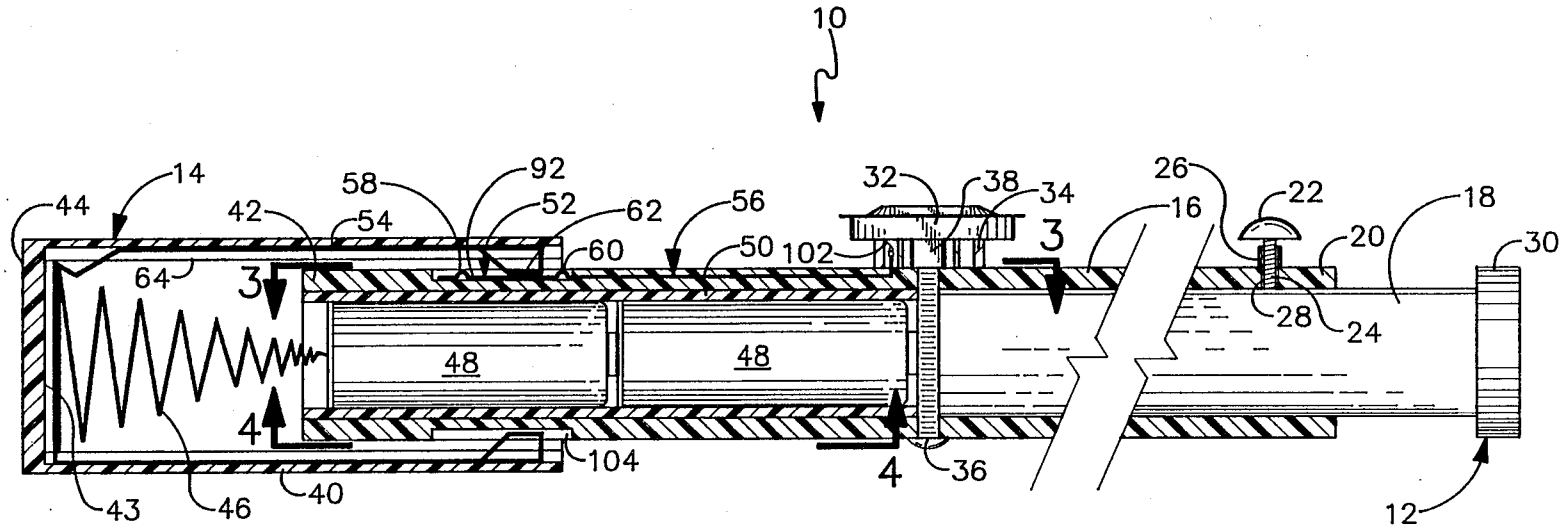
FIG. 2 is an enlarged, cross-sectional view taken substantially along line 2—2 of FIG. 1.
Figure 5:
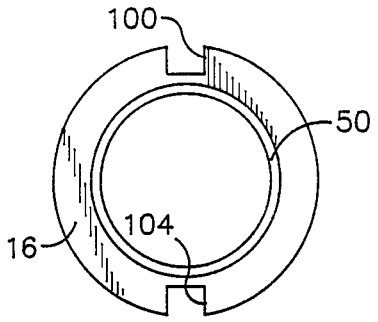
FIG. 5 is an end view of the embodiment illustrated in FIG. 3 as taken from line 5—5 of FIG. 3.

Referring initially to FIGS. 1 and 2, an alarm device 10 is disclosed preferably in the form of an extendable bar or rod. The bar alarm 10 includes a first end portion 12 and an oppositely disposed second end portion 14 which are intended for secure positioning against movable and stationary portions of a closure (not illustrated). For example, windows, sliding doors, and the like all have a movable portion which slides relative to the window jamb or door frame, which is the stationary portion of the closure structure. Typically, a simple way of preventing unauthorized opening of such closures is to place a stick or other type of bar firmly between the movable portion and the stationary portion of the closure structure when the closure is in a closed position, thereby preventing the opening of the movable closure portion. This concept is utilized in part by the present invention so that the one end 12 of the bar alarm 10 is intended for placement against, for example, the movable portion of such a closure structure, while the opposite end 14 of the bar 10 is intended for secure placement against the stationary portion of such a closure structure. It is in this position that the bar alarm 10 is set for operation as described below.

In preferred form, the bar alarm 10 includes a main housing member 16 preferably in the form of a cylinder or tube. The length of the device 10 is adjustable, and in order to provide such length adjustment, a second housing cylinder 18 projects in telescoping relationship from the first end 20 of the main tube 16. The adjustment cylinder 18 projects into the interior of the main housing 16 in a sliding fashion and may be extended outwardly from the housing 16 as far as its length will permit. Once the desired length is achieved for the device 10, the extension cylinder 18 is secured to the main housing tube 16 by the attachment mechanism 22 which is preferably in the form of a screw or bolt having threads 24. The threads 24 of the bolt 22 are engagable with a female coupling 26 disposed along the interior cylindrical surface of an attachment tube 28, the attachment tube 28 extending through the sidewall of the housing 16 and opening into the interior thereof. In this manner, the bolt 22 may be securely fastened against the outer surface of the tube 18 within the housing 16 to firmly maintain the tube 18 in its selected position relative to the main housing tube 16. A bumper pad 30 is preferably provided on the outermost end of the extendable tube 18 for engagement against the window or door closure structure. The bumper 30 may be made of any material and is preferably made of a standard rubberized or plastic material to prevent scratching or other damage to the closure frame. Moreover, the housing members 16, 18 may be manufactured from any desired material including metals, but injection molded plastic is the preferred material of construction.

An alarm mechanism 32 is provided of standard design and may be any type of alarm mechanism such as a bell, buzzer or electronic alarm capable of making a loud noise in response to an electrical signal. Since such alarm devices are readily available and well known in the art, the mechanism of the alarm 32 will not be further discussed. While the specifically illustrated embodiments show the alarm 32 mounted to the exterior surface of the main housing tube 16, it should be understood that the alarm 32 may also be mounted entirely within the tube 16 if such a construction is desired. In the illustrated form, the alarm 32 is in the form of a buzzer and is mounted to the exterior surface of the housing 16 by a buzzer mounting box 34 in the form of a cylinder interconnecting the buzzer 32 to the surface of the housing 16. An attachment bolt 36 passes entirely through the housing 16 and threadably engages a receptacle 38 which is attached to the underside of the buzzer 32. By tightening the bolt 36 into the receptacle 38, the bolt 36 firmly pulls and holds the buzzer 32 against the buzzer box 34, thereby securely but removably maintaining the buzzer 32 against the surface of the housing 16.

An end cap 40 is preferably mounted about the second end 42 of the housing 16. The end cap 40 is preferably in the form of a cylindrical cup and overlaps the end 42 of the housing 16. The end cap 40 includes an exterior end surface 44 which is intended for abutting against a closure such as a window jamb or door frame. In this manner, the surface 44 and the rubber stop 30 are the end surfaces which abut and are biased against the stationary and movable portions of the closure structure.

The end cap 40 is longitudinally translatable along the second end 42 of the housing 16 and is maintained in its position in part by a coiled spring 46 which extends between the interior of the end cap 40 and the end 42 of the housing 16. In preferred form, the end cap 40 overlaps the end 42 of the housing 16 a sufficient amount so that when the spring biasing member 46 is in its totally uncompressed, extended state, a portion of the end cap 40 remains overlapping the terminal end 42 of the housing 16. When a force is exerted against the surface 44 of the end cap 40, the spring 46 is compressed thereby translating the end cap 40 longitudinally along the housing 16 in a direction toward the buzzer 32. Such a situation occurs when the device 10 is placed between movable and stationary portions of a closure so as to at least partially compress the spring 46. While any appropriate spring biasing arrangement and material may be utilized for the spring member 46, a coiled spring of electrically conductive material such as copper, beryllium and the like is preferred so that the spring 46 may also be part of the electrical circuit for activating the buzzer 32 as described below.

In preferred form, a power source in the form of a pair of dry cells or batteries 48 are disposed within the housing 16. In the illustrated embodiment, an interior sleeve or tube 50 is positioned coaxially within the housing 16 between the housing end 42 and the bolt 36. The purpose of the sleeve 50 is to contain the batteries 48 disposed therewithin. In the illustrated arrangement, the batteries 48 contact each other and then electrically contact the bolt 36, although any other suitable electrical contact arrangement at the one end of the batteries 48 may be utilized. In this illustrated embodiment, the bolt 36 is utilized as an electrical conduit to the buzzer 32 to complete the circuit to be described below.

At the opposite end of the stacked batteries 48, the spring biasing member 46 makes electrical contact to act as a portion of the electrical circuit to the buzzer 32. It should be understood that any power source with appropriate circuitry modifications may be utilized to activate the buzzer 32, including external power sources such as house circuits and the like. The advantage of the present arrangement is that the device 10 is self-contained and does not need to be near an external power source, since it carries its own D.C. power source in the form of the batteries 48. Because the alarm 32 is rarely activated, a pair of standard of "AA", "C" or "D" cells will provide sufficient voltage as well as storage to last a considerable period of time, such as between 6–12 months.

A switch mechanism 52 is provided so that the alarm 32 of the device 10 may be activated in one of two activation modes. As described above, once the device 10 is put into its operation position, the switch mechanism 52 is arranged so that when the movable portion of the closure structure is opened, the end cap 40 is compressed against the biasing spring 46 so as to compress the overall length of the device 10. The switch mechanism is constructed so as to provide a first activation mode for the alarm 32 when such an event occurs. Moreover, should the device 10 be removed from its armed position between the movable and stationary portions of the closure structure without first disarming the alarm, the device 10 having been originally positioned so to place the spring 46 in a partially compressed state, the spring 46 moves the end cap 40 away from the buzzer 32 and extends itself to a fully uncompressed state. In this event, the switch mechanism 52 is also arranged to provide a second activation mode to activate the alarm 32. In this manner, unauthorized entry through a closure would not be possible either by unauthorized opening of the closure or by the unauthorized removal of the bar from the closure to then permit opening of the closure. It is this dual activation mode of the present invention which is one of the particularly novel features and facets of this device since it prevents an intruder from breaking glass and removing the alarm to permit opening of the closure and entry into the premises.

Referring to the switch mechanism 52 of FIGS. 2–11 in more detail, a first electrical contact member 54 is provided for engagement with a second electrical contact member 56, the second contact member 56 having a pair of contact elements 58, 60. The contact members 54, 56 may be constructed from any electrically conductive material, such as copper, beryllium, steel, and the like. While the present invention envisions one contact member being connected for movement with the end cap 40 and the other contact member being connected for stationary disposition on the tube 16, the following described and illustrated arrangement is a particularly desired embodiment, although other arrangements of contact elements and sliding mechanisms are envisioned for use with the present invention.

In the illustrated embodiment, the first contact member 54 is disposed in the end cap 40 and includes an armature 62 at one end thereof. The armature 62 preferably is in the form of a closed "J" or loop and extends radially inwardly from the inner surface 64 of the end cap 40. This is particularly illustrated in FIG. 10. The closed "J" form or loop 62 includes an end member 66 preferably extending all the way back to the base 70 of the contact 54 to provide a solid loop armature 62. This aspect is important since it prevents deformation and bending of the armature 62 over extended use, such deformation possibly affecting the electrical contact capability of the armature 62.

Figure 10:
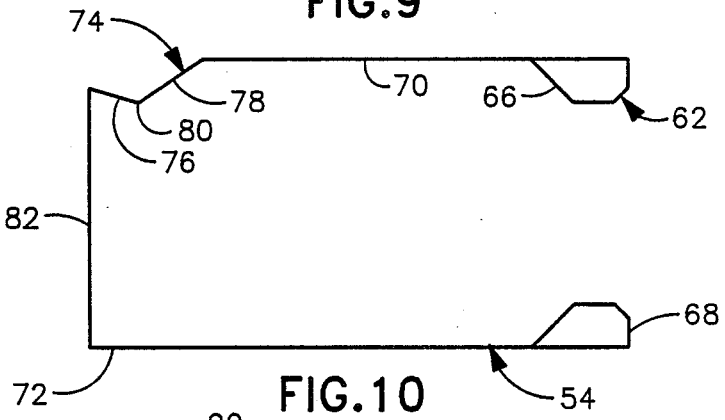
FIG. 10 is an enlarged side view of a contact member disposed within the end cap of the embodiment illustrated in FIG. 2.

Referring more particularly to FIG. 10, the contact member 54 is generally in the shape of a "U" terminating in two distal end, one of the ends being the armature 62 and the other end being a like member 68 preferably projecting radially inwardly from the cap surface 64, a mirror image of the terminal armature 62. One, or both, of the arms 70, 72 may include a biasing mechanism in the form of a radially inwardly angled end portion 74. In this instance, the biasing mechanism 74 is located in the arm 72 and includes a first leg 76 and a second leg 78 with a bend 80 intermediate the same. Consequently, when the contact member 54 is inserted into the end cap 40 as described below, the mechanism 74 insures that the arms 70, 72 remain spring loaded radially outwardly and firmly engaged within the end cap 40. The arms 70, 72 are joined by in a base member 82.

Figure 6:
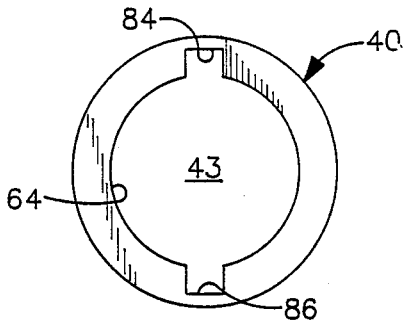
FIG. 6 is an interior end view of the end cap of the embodiment illustrated in FIGS. 1 and 2.
Figure 7:
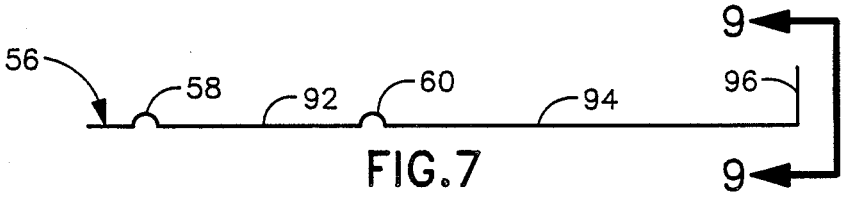
FIG. 7 is an enlarged side view of a contact member utilized with the embodiment illustrated in FIG. 2.
Figure 8:
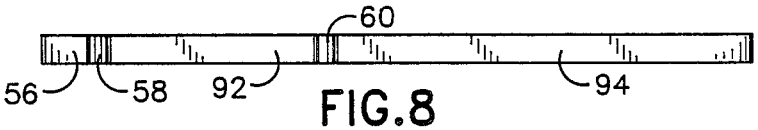
FIG. 8 is a top plan view of the contact member illustrated in FIG. 7.
Figure 11:
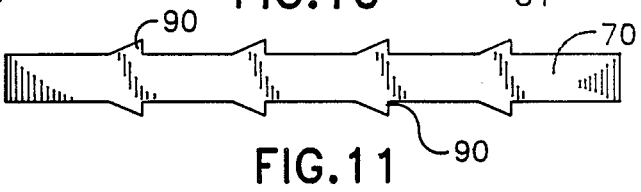
FIG. 11 is a top plan view of the contact member illustrated in FIG. 10.

Referring to FIGS. 6 and 10, the end cap 40 includes a pair of grooves 84, 86 disposed in the inner surface 64 of the cap 40. The grooves 84, 86 are preferably disposed radially opposite each other and extend the entire length of the end cap 40 terminating along the interior rear surface 43. As illustrated in FIG. 2, the contact member 54 is inserted into the end cap 40 by engaging the legs 70, 72 thereof within the channels or grooves 84, 86 with the base 82 being positioned at or proximate to the interior surface 43 of the end cap 40. To further ensure that the contact member 54 remains in place once inserted into the end cap 40, each arm 70, 72 of the contact member 54 is preferably in the form of the arm 70 as illustrated in FIG. 11. In FIG. 11, the arm 70 includes a plurality of barbs or teeth 90 extending outwardly therefrom in a slanted fashion so that once the contact member 54 is inserted into the preferred plastic end cap 40, the barbs 90 prevent removal of the contact member 54, the teeth 90 digging into or engaging the side surfaces of the grooves 84, 86.

While FIG. 11 illustrates the arm 70, it should be understood that the arm 72 is preferably similarly constructed along a portion of its length. Since the contact member 54 is substantially the same in construction along either arm 70, 72, except for the presence of the biasing mechanism 74, the contact member 54 may be inserted into the end cap 40 with the arm 70 engaging either channel or groove 84, 86. Once the contact member 54 is so fully engaged within the end cap 40, as illustrated in FIG. 2, the coil spring 46 is biased against the base member 82 of the contact member 54 to provided a firm surface for engagement as well as to provide electrical contact therewith. Thus, the battery cells 48 of the device 10 are electrically connected to the contact member 54 through the coil spring 46 and the base 82 of the contact 54.

Figure 9:
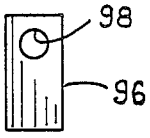
FIG. 9 is an end view of the contact element of FIG. 7 taken substantially from 9—9 of FIG. 7.

The remaining contact member 56 of the switch mechanism 52 includes a pair of contact elements 58, 60. In the preferred form, the contact member 56 is a unitary structure and includes the contact elements 58, 60 interconnected by a straight, continuous contact portion 92. Contact elements 58, 60 may simply be crimped or raised areas along the portion 92, or they may be totally separate entities. In addition, an arm 94 extends beyond the contact element 60 and terminates in an end portion 96 which preferably is bent or aligned at right angles to the arm portion 94. As illustrated in FIG. 9, the end portion 96 includes an aperture 98 which provides easy connection to an electrical wire as described below. In this particular preferred embodiment, the contact portion 92 disposed between the contact elements 58, 60 is coated on its upper surface with a hard, non-conductive material such as Teflon or any other suitable polymer plastic. This coating is provided so that the armature 62 may ride along the surface of the coated contact portion 92 without making electrical contact with the contact member 56 except when engaging the contact elements 58, 60. This arrangement permits the manufacture of the contact element 56 from a single metal stamping process, which is relatively inexpensive. Other arrangements for this device may include separate contact elements 58, 60 interconnected by a wire or other electrical conduit so that the space between the contact elements 58, 60 is simply a non-conductive area unattached to the contact element 56. However, the illustrated embodiment is preferred because of its ease of manufacture and assembly within the device 10, as indicated.

Referring now to FIGS. 2–5 and 7–9, the area of the housing 16 proximate the end portion 42 includes a longitudinal slot 100. As can be seen from FIGS. 2 and 3, the longitudinal slot 100 does not pass entirely through the wall of the housing 16 but only approximately half-way. The portion of the contact member 56 which includes the contact elements 58, 60 and the interconnecting portion 92 are positioned within the slot 100 so as to be exposed to the exterior of the housing 16. The contact portion 94 of the contact member 56 extends an additional length of the wall of the housing 16 and is preferably embedded within the housing 16 during the manufacture thereof. The length of the member 94 is such that the terminal portion 96 of the contact member 56 extends upwardly into the buzzer box 34. In this manner, the terminal portion 96 may be protected from environmental elements since it is situated within the buzzer box 34. An electrical wire 102 or other similar conduit member is provided to interconnect the terminal end 96 through the aperture 98 thereof to the appropriate contact member (not illustrated) of the buzzer 32 so as to complete an electrical circuit when the switch mechanism 52 is activated. Thus, the two electrical leads to the buzzer 32 include the electrical wire 102 and the bolt 36. Consequently, the electrical circuit of the device 10 extends from the battery cells 48 through the spring member 46, the contact member 54, the switch mechanism 52, the contact member 56, the electrical connector 102, the buzzer 32, the bolt 36 and back to the battery cells 48.

As can be seen particularly in FIGS. 2–5, a corresponding slot 104 is disposed in the end portion of the housing 16 radially opposite the slot 100. The slot 104 is sized and shaped approximately the same as the slot or groove 100 and similarly does not extend through the entire thickness of the housing 16. The purpose of the slot 104 is to engage the end portion 68 of the contact element 54 to guide the end cap 40 longitudinally relative to the housing 16 during translational movement of the end cap 40. In this manner, the end portions 62, 68 of the contact 54 extend into and ride along the grooves 100, 104, respectively. With respect to the switch mechanism 52, the armature 62 rides along within the groove 100 against the surface 92 between the contact elements 58, 60 of the contact member 56. When the armature 62 is merely riding along or positioned on the surface of contact portion 92, so as to not engage the contact elements 58, 60, there is no electrical connection between the contact members 56 and 54. In this instance, the circuit to the buzzer 32 is not active and the buzzer 32 remains silent. Hence, the device 10 is armed but in an inactive alarm mode.

When the armature 62 is moved along the slot 100 such as to contact either contact element 58 or 60, the electrical circuit is completed and provides electrical current from the battery cells 48 to the buzzer or alarm 32, thereby activating the alarm 32. Thus, the contact elements 58, 60 represent or define the two activation modes of the device 10, with the area 92 of the contact member 56 defining the inactive alarm mode wherein the electrical circuit is not complete.

Because of the polymer or other non-conductive surface disposed on the surface of the portion 92, the electrical circuit does not connect between the portion 92 and the armature 62. The spring mechanism 46 is preferably sized and positioned so that when it is in its normally unbiased state, it exerts an outward pressure against the end cap 40 so as to engage the armature 62 against the outermost disposed contact element 58. When the end cap 40 is compressed toward the buzzer 32 so as to partially compress the spring 46, the armature 62 is disposed along the contact portion 92 between the contact elements 58, 60 and thereby defines the inactive alarm mode. When the end cap 40 is sufficiently pressed toward the buzzer 32 so as to substantially fully compress the spring 46, the armature 62 comes into contact with the inwardly disposed contact element 60 and thereby completes the electrical circuit again. Thus, either outward movement of the end cap 40 and device 10 by the release of the spring 46, or sufficient inward movement of the cap 40 so to compress the device 10, will activate the alarm 32.

The overall operation of the device 10 is relatively simple. When the device 10 is placed into position between a movable and stationary portion of a closure structure, the telescoping housing portion 18 is first extended sufficiently so that the armature 62 rests along the portion 92 of the contact element 56 to position the device 10 in its inactive alarm mode. Once this is achieved, the bolt 22 is tighten against the telescoping tube 18, and the alarm device 10 is then in its inactive but armed position. Should the movable portion of the closure be opened so as to compress the device 10 and engage the armature 62 against the contact element 60, or should the device 10 be kicked or otherwise moved from its position between the movable and stationary portions of the closure so as to allow the spring 46 to extend the end cap 40 and thereby engage the armature 62 against the contact element 58, the alarm 32 is activated.

In order to disarm the device 10 so that the device 10 may be stored or initially placed into position, a pair of channel slots 106, 108 are provided in the housing 16 in transverse orientation to the longitudinal slots 100, 104, respectively. The channel slots 106, 108 are of sufficient length to permit the ends 62, 68 of the contact member 54 to move fully therewithin when the end cap 40 is rotated relative to the housing 16.

Once the ends 62, 68 of the contact member 54 are positioned within the channel slots 106, 108, the device 10 is disarmed since the switch mechanism 52 cannot be operated in any activation mode. In addition, a pair of entry channels 110, 112 are provided longitudinally in the housing 16 between the very end 42 of the housing 16 and the transverse slots 106, 108, respectively. The entry channels 110, 112 are provided to permit the end cap 40 to be removed entirely from the housing 16 so as to access the cells 48 and replace the same when necessary. It is envisioned, however, that the end cap 40 is not removed when the device 10 is disarmed except for either maintenance of the interior of the device 10 or replacement of the power cells 48. Thus, a simple rotational movement of the end cap 40 relative to the housing 16 at the appropriate location along the slots 100, 104 will disarm the device 10 by removing the contact armature 62 from engagement with any portion of the contact member 56. This position can be maintained because the armature 62 and the terminal portion 68 will be maintained firmly within the transverse slots 106, 108, respectively, by the bias of the spring 46.

In order to easily position the device 10 within a closure, the device 10 is placed in its disarmed position with the end portions 62, 68 of the contact 54 being positioned within the transverse slots 106, 108, respectively. When the device 10 has been placed at the appropriate location, the telescoping tube 18 is extended until the rubber end 30 and the surface 44 of the end cap 40 abut the respective jambs of the movable portion and the stationary portion of the closure. When the ends 30 and 44 are in firm contact with the appropriate portions of the closure, the screw or bolt 22 is securely tightened against the telescoping tube 18 so as to maintain this position. When this has been achieved, the end cap 40 is then rotated so as to disengage the terminal end portions 62, 68 from the transverse slots 106, 108 and to position the terminal portions 62, 68 into the slots 100, 104. In this instance, the armature 62 is in position over the portion 92 of the contact member 56 between the contact elements 58, 60. In this manner, the device 10 is then positioned and remains in its armed but inactive alarm mode. As described above, should the device 10 be either sufficiently compressed so as to contact armature 62 against the contact element 60 by unauthorized opening of the movable portion of the closure or extended so as to contact the armature 62 against the contact element 58 by unauthorized removal of the device 10 from the closure, the switch mechanism 52 will be placed into one of its activation modes and thus trigger and activate the alarm 32. A particularly important aspect of the present invention is that the contact switch mechanism 52 is positioned between the end cap 40 and the housing 16 and is integrally interconnected therewith so as to avoid any external switching mechanism as well as power sources, trigger plungers and the like as required in many prior art structures.

As can be seen from the above, the present invention is a simple yet very effective security device for closures and the like having at least one movable portion. The device is, in its illustrated and preferred form, entirely self-contained, is easily placed into position and armed, and is readily maintained in such a position in an inactive mode for extended periods of time without having to replace the power sources thereof. Moreover, this particular security device has a dual activation mode so as to alarm the owners of a residence or other premises to the intrusion of a burglar either by unauthorized removal of the device or by the unauthorized opening of the closure. Such dual activation modes are not present on other types of devices which are simple and uncomplicated in construction. Finally, because of the simplicity of the device, it is easily and inexpensively manufactured thus providing a simple, inexpensive, yet effective security device which is readily affordable by the majority of people.

While the foregoing description and the illustration of the present invention have been particularly shown in detail with reference to preferred embodiments and modifications thereof, it should be understood by those skilled in the art that the foregoing and other modifications are exemplary only, and that equivalent changes and detail may be employed without departing from the spirit and scope of the invention as claimed except as precluded by the prior art.

I claim:

1. An alarm device for closures such as windows, sliding doors, and the like, said device comprising:

an elongated housing having first and second ends;

an alarm responsive to an electrical signal;

switch means for controlling said electrical signal and including contact means for activating said alarm in each of two activation modes corresponding to extension and compression of said housing;

means disposed at said housing first end for adjusting the length of said housing; and means disposed proximate said housing second end for enabling movement of said contact means to initiate said two activation modes from an inactive alarm mode in cooperation with said housing length adjustment means.

2. The device as claimed in claim 1, wherein said contact movement means includes spring bias means adapted for urging said contact means in a first direction along a longitudinal path defined in said housing to initiate one of said activation modes.

3. The device as claimed in claim 2, wherein said spring bias means is further adapted for compression to permit movement of said contact means in a second opposite direction along said longitudinal path to initiate the second of said activation modes as well as to maintain said inactive alarm mode along said path between said activation modes.

4. The device as claimed in claim 3, wherein said spring bias means is compressible to maintain said contact means in said inactive mode by said housing length adjustment means.

5. The device as claimed in claim 1, wherein said contact means comprises a pair of spaced electrical contacts defining said first and second activation modes and a contact member movable therebetween to initiate said activation modes upon contact therewith, said contact member activating said alarm upon contact with either of said electrical contacts.

6. The device as claimed in claim 5, wherein said housing second end includes an end cap disposed thereabout, said electrical contacts being disposed in said housing second end and said contact member being disposed in said end cap.

7. The device as claimed in claim 5, wherein said housing second end includes means for disengaging said contact member from said activation modes and said inactive alarm mode to thereby disarm said device.

8. The device as claimed in claim 7, wherein said disengaging means includes a channel disposed in said second end for directing said contact member away from said electrical contacts in the space defined therebetween.

9. The device as claimed in claim 8, wherein said electrical contacts are spaced apart and disposed in an elongated longitudinal slot located in said housing along which said contact member is movable, the space between said contacts in said slot defining said inactive alarm mode and communicating with said channel such that said contact member is disengagable from said longitudinal slot by rotating said end cap relative to said housing to engage said contact member with said channel and thereby disarm said device.

10. The device as claimed in claim 5, wherein said said housing second end includes an end cap disposed thereabout, and wherein said spring bias means comprises a compression spring disposed between the interior surface of said end cap and the terminal end of said housing second end, said end cap being longitudinally translatable along said housing second end.

11. The device as claimed in claim 10, wherein the space between said electrical contacts defines said inactive alarm mode, and said compression spring normally biases said contact member against the longitudinally outwardly disposed contact element.

12. The device as claimed in claim 11, wherein said contact member is movable in the space between said contact elements and therefore movable into said inactive alarm mode by compressing said end cap towards said housing second end and thereby compressing said spring.

13. The device as claimed in claim 12, wherein said end cap may be compressed by adjusting the length of said housing length with said housing adjustment means to engage said first and second ends of said device against a closure and place said spring into compression.

14. The device as claimed in claim 1, wherein said housing length adjustment means comprises a telescoping tubular member extendable longitudinally from said housing first end to adjustably determine the overall length of said device to engage said closure with said first and second housing ends, thereby placing said device into said inactive alarm mode.

15. The device as claimed in claim 14, wherein said contact movement means comprises a longitudinally translatable end cap disposed on said housing second end for telescoping movement along said second end to position said contact means in response to the positioning of said housing length adjustment tubular member relative to placement against a closure.

16. The device as claimed in claim 15, wherein said contact means comprises a pair of spaced contact elements and a contact member movable therebetween to define said activation modes, said inactive alarm mode being defined by the positioning of said contact member in the space between said contact elements with the relative positioning of said contact member and said contact elements being defined by the housing length adjustment tubular member position and said end cap during operation of said device.

17. The device as claimed in claim 16, wherein said contact elements and said contact member are positioned between the interior of said end cap and the exterior of said housing second end with said contact member being connected to and movable with said end cap.

18. The device as claimed in claim 1, wherein said device includes a power source connected to said alarm by said switch means.

19. The device as claimed in claim 18, wherein said housing further includes an interior chamber, said power source being disposed within said interior chamber.

20. The device as claimed in claim 1, wherein said alarm is disposed, at least in part, exterior to said device.

21. The device as claimed in claim 1, wherein said contact movement means includes spring bias means for enabling said first activation mode to be initiated by the longitudinal extension of said device in response to extension of said spring bias means, and for enabling said second activation mode to be initiated by sufficient compression of said spring bias means, said inactive alarm mode being defined by partial compression of said spring bias means an amount less than the amount necessary to initiate said second activation mode.

22. A burglar alarm device for closures having a movable portion and a stationary portion, such as windows, sliding doors and the like, said device comprising:

an elongated housing having first and second ends for placement between said movable and stationary closure portions;

an alarm responsive to an electrical signal;

switch means for controlling said electrical signal, said switch means including spaced contact elements and a contact armature movable between said contact elements to define two alarm activation modes corresponding to extension and compression of said housing when engaged therewith and to further define an inactive alarm mode when disconnected from said contact elements;

means disposed at said housing first end for adjusting the length of said housing to permit engagement of said housing first and second ends with the movable and stationary portions of said closure; and means disposed proximate said housing second end to permit movement of said contact armature between said contact elements to initiate either activation mode as well as to maintain said inactive alarm mode in cooperation with said housing length adjustment means.

23. The device as claimed in claim 22, wherein said contact elements and said contact armature are disposed between said housing and said armature movement means.

24. The device as claimed in claim 23, wherein said armature movement means comprises an end cap longitudinally translatable relative to said housing second end, the movement of said contact armature between said spaced contact elements corresponding to the longitudinal translation of said end cap.

25. The device as claimed in claim 24, wherein said armature movement means further includes spring bias means disposed between said end cap and the housing second end to control the longitudinal movement of said end cap in cooperation with said housing length adjustment means.

26. The device as claimed in claim 25, wherein said spring bias means comprises a compression spring adapted to contact said contact armature with the longitudinally outermost disposed contact element when in an unbiased state, and further adapted to permit contact between said contact armature and the longitudinally innermost disposed contact element when in compression, said inactive alarm mode being defined by the partial compression of said spring less than the compression needed to contact said armature with the longitudinally innermost contact element.

27. The device as claimed in claim 26, wherein said said housing length adjustment means comprises a telescoping tubular member extendable from said housing first end and adapted to permit the positioning of said device between the movable and stationary portions of a closure such that said spring is normally under partial compression and said switch means is in an inactive alarm mode, said switch means being placed in activation mode when said movable closure portion is moved toward said stationary closure portion to further compress said spring and thereby engage said contact armature with one said contact element, said switch means further being placed in an activation mode when said device is removed from a position between the movable and stationary closure portions thereby releasing the compressed spring and engaging said contact armature with the opposite contact element.

28. The device as claimed in claim 24, wherein said device further includes means for disarming said device to prevent movement of said contact armature between said contact elements.

29. The device as claimed in claim 28, wherein said disarming means comprises a channel slot disposed in said housing second end and transversely oriented to and communicating with the spacing between said contact elements, said contact armature being rotationally movable relative to said housing to enter said channel slot and disengage from said contact element space.

30. In an alarm device for closures such as windows, sliding doors, and the like, wherein the closures includes a movable portion and a stationary portion such that the alarm device is adapted for positioning between the movable and stationary portions of the closure to detect unauthorized opening of said movable portion, and wherein said device includes a housing member having first and second ends, means for adjusting the length of said housing to permit firm engagement of said first and second ends with the movable and stationary portions of a closure, an alarm responsive to an electrical signal, a power source disposed in said housing, and switch means for controlling said electrical signal and connecting said power source to said alarm to selectively activate said alarm, the improvement comprising:

contact means for selectively activating said alarm in each of two activation modes corresponding to compression and extension of said housing; and means disposed at one end of said housing to enable movement of said contact means in response to said housing compression and extension to initiate said two activation modes as well as to maintain an inactive alarm mode in cooperation with said housing length adjustment means.

31. The improvement of claim 30, wherein said contact means comprises a pair of spaced contact elements and a contact armature movable therebetween to define said activation modes when engaged therewith, said contact armature further defining said inactive alarm mode when disengaged from said contact elements and positioned in the space therebetween.

32. The improvement of claim 31, wherein said contact movement means comprises a longitudinally translatable end cap disposed on one end of said housing, said contact means being disposed between said end cap and said housing such that said contact armature movement corresponds to the longitudinal movement of said end cap relative to said housing.

33. The improvement of claim 32, wherein said contact movement means further include spring bias means disposed between said end cap and the end of said housing to control the movement of said end cap and said contact armature in cooperation with said housing length adjustment means.

34. The improvement of claim 33, wherein said housing length adjustment means comprises a telescoping tubular member extendable from the end of said housing opposite said end cap to permit positioning of said device between stationary and movable portions of a closure with said spring bias member being disposed in partial compression to position said contact means in said inactive alarm mode, thereby permitting detection of unauthorized opening of said closure by the compression of said housing as well as to detect unauthorized removal of said device from its position relative to said closure by the extension of said housing if removed from its biased position against said closure portions.

35. The improvement of claim 32, wherein said improvement further includes disarming means comprising a channel slot transversely oriented to the space between said contact elements and adapted for receiving said contact armature in response to rotation of said end cap relative to said housing.

* * * * *